United States Patent [19]

Way

[11] Patent Number: 4,624,461

[45] Date of Patent: Nov. 25, 1986

[54] GOLF PRACTISING DEVICES

[75] Inventor: Denys R. Way, Braintree, United Kingdom

[73] Assignee: Golfing Way Limited, United Kingdom

[21] Appl. No.: 636,171

[22] Filed: Jul. 31, 1984

[30] Foreign Application Priority Data

Aug. 9, 1983 [GB] United Kingdom ..... 8321410
Apr. 19, 1984 [GB] United Kingdom ..... 8410271

[51] Int. Cl.[4] ..... A63B 69/36

[52] U.S. Cl. ..... 273/184 B; 273/197 A; 273/200 B

[58] Field of Search ..... 273/200 B, 184 B, 185 D, 273/197 R, 197 A, 26 E

[56] References Cited

U.S. PATENT DOCUMENTS

| | | | |
|---|---|---|---|
| 1,419,636 | 6/1922 | MacDonald | 273/185 D |
| 1,973,207 | 9/1934 | Hellum et al. | 273/200 B |
| 3,399,571 | 9/1968 | Parsons | 273/185 D |
| 3,452,990 | 7/1969 | Nichols | 273/185 D |
| 3,601,408 | 8/1971 | Wright | 273/186 R |
| 3,643,961 | 2/1972 | Schroeder | 273/197 R |
| 3,647,219 | 3/1972 | Ravatt | 273/184 B |
| 3,738,660 | 6/1973 | Branz | 273/185 D |
| 3,981,508 | 9/1976 | Koblick | 273/200 B |

FOREIGN PATENT DOCUMENTS

| | | | |
|---|---|---|---|
| 242400 | 11/1925 | United Kingdom | 273/200 B |
| 410864 | 5/1934 | United Kingdom | 273/200 B |
| 442241 | 2/1936 | United Kingdom | 273/200 B |
| 447316 | 5/1936 | United Kingdom | 273/200 B |
| 1076573 | 8/1967 | United Kingdom | 273/184 B |
| 1287142 | 8/1972 | United Kingdom | 273/185 D |
| 1553219 | 9/1979 | United Kingdom | 273/185 D |
| 2120105 | 11/1983 | United Kingdom | 273/184 B |

*Primary Examiner*—George J. Marlo
*Attorney, Agent, or Firm*—Wood, Herron & Evans

[57] ABSTRACT

A golf practising device having a one piece molded mounting arm with a ball at each end, that arm being pivotally mounted to a base about a horizontal axis so as to allow substantially free rotation thereabout, and that arm being reinforced by a novel structure in such a way that the device simulates the feel of a conventional golf ball when either of the device's balls is hit by a golf club. The novel reinforcement structure includes a reinforcing rib on each of the arm's side faces that extends lengthwise between the two balls, a reinforcing rib on the arm's front face that extends lengthwise from one ball toward the other but stops substantially short thereof, and a reinforcing rib on the arm's rear face that extends from the other ball toward the one ball but stops substantially short thereof, all reinforcing ribs extending outwardly from the arm's faces.

4 Claims, 3 Drawing Figures

GOLF PRACTISING DEVICES

This invention relates to a golf practising device and in particular to the practise driving/hitting of a golf ball.

BACKGROUND OF THE INVENTION

It is usual for golfers when wishing to practise tee or fairway shots to take a number of golf balls and hit them on the practice range of a golf course. Such an arrangement is often inconvenient, for example, the time and cost to travel to the nearest golf course, the possibility of losing some golf balls on the range and the possibility of the practice range being already in use by other golfers.

In order to overcome some of these problems, and allow a golfer to practise at home, devices are known which support a golf ball at the end of a spindle whereby on hitting it may rotate about a vertical axis. Such arrangements have the disadvantages firstly in that the part of the device supporting the spindle may be struck and damaged by a 'wild' shot and secondly in that the spindle can be supported on only one side thereof whereby the arrangement is inherently unstable.

Other devices are known which support a golf ball at the end of a biased spindle whereby free rotation is prevented. The disadvantage of this arrangement is that it does not give, when the ball is struck, the 'feel' of a conventional golf ball to a golfer.

It is an object to overcome or mitigate one or more of the above problems.

SUMMARY OF THE INVENTION

A golf practising device in accordance with the invention comprises a golf ball member integral with a mounting member which is pivotally mounted about a horizontal axis to a base structure so as to allow substantially free rotation of the ball in a vertical plane while retaining the ball in the immediate vicinity of the base structure, and reinforcing means extending substantially at right angles to the horizontal axis.

Such a device is simple in design, easy to use and relatively inexpensive to manufacture.

The overall arrangement and construction of the device is such that it may be used many times without breakage yet provide the golfer when he hits the ball member with the feel of a conventional golf ball.

It has been found in particular that the provision of an integral golf ball and mounting member with reinforcement means helps to give the necessary inherent strength to the arrangement to absorb the "hitting" energy on the ball, while the provision of the ball and mounting member to pivot about a horizontal axis means that the other parts of the device apart from the ball member itself do not extend above the hitting surface and thus are not liable to damage or whatever, and finally the provision of a freely rotatable ball helps to give the correct feel of a conventional golf ball.

The simulated golf ball and intergral mounting members are pivotally mounted to the base structure via an axle member, preferably a steel rod, which extends along a horizontal axis relative to the ground. The arrangement is preferably such that both ends of the axle member are supported in order to cope with the stress that occurs when the golfer hits the ball member.

The base structure may be provided with adjustable means in order to alter the height of the ball member above the base structure so as to simulate upwardly or downwardly sloping ground and/or simulate a tee or ground shot. Means may be provided to locate the simulated golf ball at rest just above the upper surface of the base structure ready for hitting.

This simulated golf ball may be suitably provided with means on said ball to indicate actual point of contact of the ball with the club/wood, such that the golfer knows whether he has correctly hit the ball or not.

Means may also be provided on the base structure to measure and indicate how hard the ball has been hit and/or and distance that the ball would have travelled if it had not been mounted.

Such a golf practising device may be assayed substantially to simulate the feel of a conventional golf ball by providing the correct weight, elasticity and rotatability of the components to achieve such a result, and retains the ball on hitting in the immediate vicinity of the device so that the ball may be re-hit immediately.

Clearly such an arrangement is versatile and may be used nearly anywhere including at home or at the office, negating the need to use a practice range at a golf course and the possibility of losing balls thereon.

Preferably the upper surface of the base structure in use is flush with ground level, and the golf ball member is mounted to the base structure in such a way that on being hit by a golf club/wood the golf ball member is free to rotate freely substantially below ground level.

The invention will now be described, by way of example, with reference to the accompanying drawings, in which:

DESCRIPTION OF THE PREFERRED EMBODIMENTS

Figure 1:
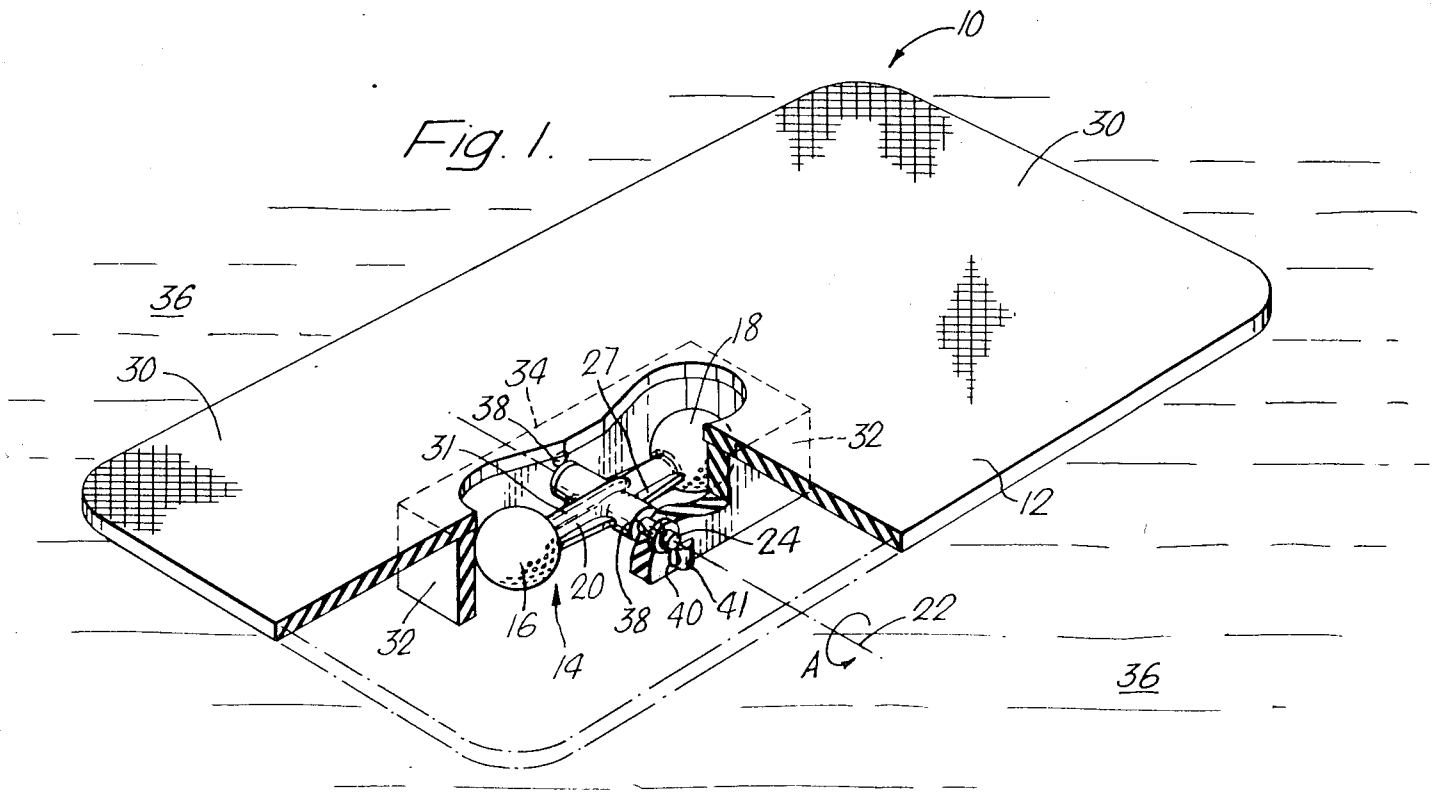
FIG. 1 is a perspective view of one embodiment of the device in accordance with the invention.

The golf practising device 10 shown in FIG. 1 comprises a base structure 12 and a spindle 14 mounted thereto. The spindle 14 has two simulated golf ball members 16 and 18, one at each end of a stem mounting member 20 so as to counterweight and balance each other, the members 16, 18 and 20 being wholly integral so as to provide the necessary rigidity against the force and stress/strain caused by a golf club/wood hitting the ball member.

The spindle 14 is pivotally mounted to the base structure 12 about a horizontal axis 22, and specially on a steel rod 24 which extends along that axis. The rod 24 passes through a bore 26 provided in a central elongated portion 28 of the mounting member 20, such that the spindle 14 may rotate substantially free about the axis 22 and in the vertical plane 23. Preferably the bore 26 of the spindle 14 is lined by a steel insert 29 in order to prevent wear and tear of the spindle 14 on the steel rod 24.

The base structure 12 comprises two main portions, an upper portion 30 which defines a 'playing' surface on which the golfer swings his golf club/wood and a lower portion 32 which is hollow and in which the rod 24 extends there across such that both ends of the rod are securely supported to the portion 32 to provide rigidity to the device 10.

Preferably the upper portion 30 is of rubber with a linen insert in order to prevent quick wear and tear, while the lower portion 32 is also made of rubber. The use of rubber is of advantage due to the fact that it 'absorbs' the various stresses and strains on the device caused by the ball member being hit, and further in that there is no problem with regard to rust/corrosion.

The lower portion 32 has a rectangularly shaped outer edge (see 34), the 'squareness' of the leading or front end being such as to provide rigidity and stability to the device 10 when the ball member is struck. The side walls of the portion 32 meanwhile are provided with inserts of plates of metal in order firstly to give a better hitting feel to the ball when struck and secondly to provide extra rigidity and stabiltiy to the device.

In use, a hole must be dug or formed in the ground 36 corresponding in width and length to the lower portion 32 such that when the device 10 is placed therein, the device 10 is firmly secured in the ground and whereby the upper portion 30 is substantially level with the upper surface of the ground 36. A golfer wishing to practice a golf shot can then simply hit one of the ball members 16 or 18 which extends above the upper portion 30, after which the ball rotates (see arrow A) within the lower portion 32 and about the axis 22 thereby remaining in the immediate vicinity of the base structure 12. The rod 24 is rigidly attached to slots 38 in the lower portion by securing means (e.g. split pin and washer) 40 at each end of the rod. The rod 24 and securing means 40 are adjustable between various alternative positions in the slots 38 in order to alter the height of the ball member 16 or 18 above the upper portion 30 so as to simulate upward or downward sloping ground and/or simulate a tee or ground shot.

Lugs 41 are provided on the outer side wall of the lower portion 32, against which the securing means 40 engage thereby preventing any further rotation of the rod 24.

Figure 2:
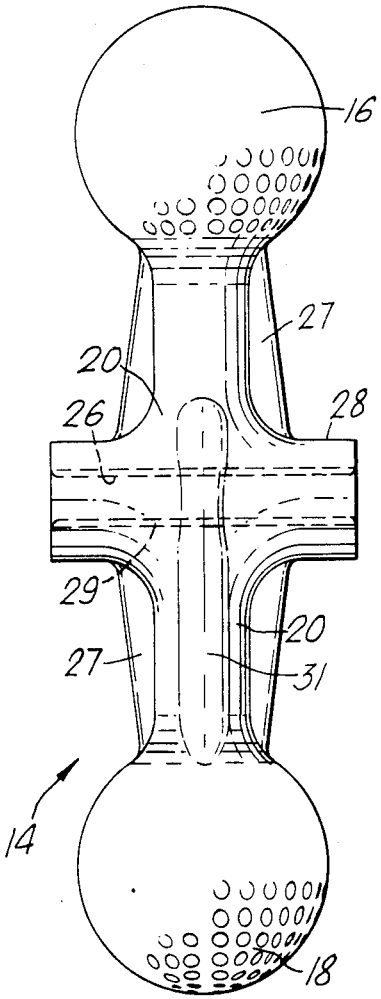
FIG. 2 shows in greater detail a front view of a portion of the device of FIG. 1.
Figure 3:
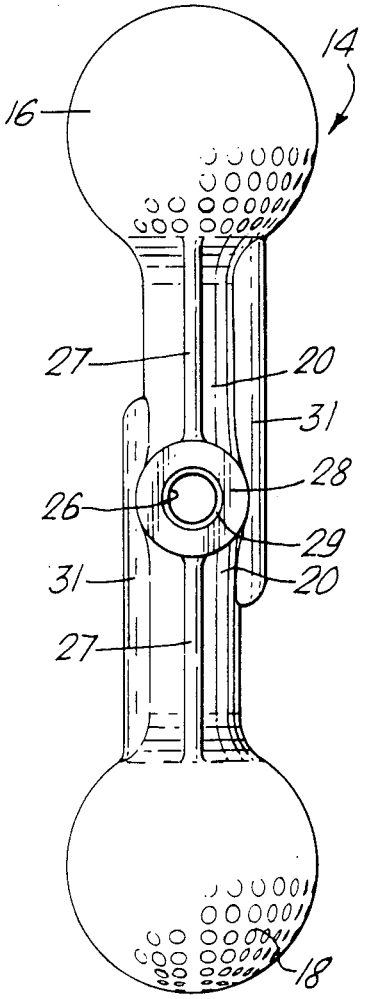
FIG. 3 shows the side view of the portion of the device as shown in FIG. 2.

The spindle 14 shown in FIGS. 2 and 3 is formed from a single mould of hard plastic material preferably of hardness in the range of 30 to 52 (as measured by Durometer D—Method 150 54868). Even more preferably the plastic material is polyurethane and specifically polyurethane 4492 AC, 192 or 150. Polyurethane 4492 AC which has been found to be the ideal spindle material has a hardness of 42, and a tensile strength of 42.4 MPa (Method 150 S3777(E)) and a Tear Strength (Angle) of 127 KN (Method DIN 53515).

The weight of the spindle 14 is preferably in the range of 3.8 to 4.2 oz. and even more preferably 4 oz. in order to provide the necessary "feel" of a conventional golf ball when hit, and the use of Polyurathane 4492AC due to its elasticity and density was found to be ideal in this respect.

The spindle 14 is also provided with integral reinforcing ribs 27 which extend on both sides of the spindle from the central portion 28 of the stem member 20 to the ball members 16 and 18 in order to provide extra rigidity to the spindle 14. These ribs 27 extend substantially at right angles to the horizontal axis 22, and further are positioned in a vertical plane containing that axis 22 whereby they are not damaged when a golf club/wood strikes a ball member.

Further but smaller reinforcing ribs 31 integral with the spindle 14 are also provided which extend on both the front and rear faces only partly between the ball members 16 and 18 in a vertical plane at right angles to the axis 22, so as to provide a certain extra resistance against the effects of the force exerted when the ball member is struck.

In particular, one reinforcing rib 31 extends between the ball member 16 and the central portion 28, while the other reinforcing rib 31 extends between the ball member 18 and the central portion 28. Both ribs 31 extend from the approximate point of the ball members 16 and 18 at which they would be struck by a golf club/wood.

The ball members 16 and 18 can be covered in chalk or other substance which on being hit would indicate the actual point of contact with the club/wood head and provide information to the golfer as to whether the ball was sliced, hooked, topped etc.

The spindle may be provided with ribs (not shown) which engage on every revolution a lug mounted to the base structure. The ribs and lug may also act as a measuring device, each time the rib acting on the lug measuring half a revolution.

The device 10 may be provided with a strain gauge, a photo-electric cell beam or magnetised strips in order to measure the number of revolutions.

This information would then be computed to give either an indication of yards travelled, revolutions per minute, velocity or the total number of revolutions.

Means in the form of stoppers (not shown) may also be provided on the base structure to locate the simulated golf ball at rest just above the upper surface of the base structure ready for hitting. In this regard, it has been found however that due to the counterweighting and arrangement of the spindle that there is a certain inherent capability of the spindle to stop at the correct position ready for re-hitting in any case.

The upper portion 30 of the device 10, which is flush with the upper surface of the ground 36, may be adjusted to simulate upwardly or downwardly sloping ground and/or simulate a tee or rough lie shot.

In the device shown in FIGS. 1 to 3, an aging rotating spindle can be replaced with a new spindle after wear and tear.

The foregoing golf practise device may form part of a platform adjustably sloped to ground level and on which a golfer stands. The upper surfaces of the device would be flush with the platform level such that the golfer on the platform hitting the simulated golf ball can practise upward or downward sloping lies.

Although the invention has been described in terms of certain preferred embodiments, person skilled in the art to which this invention pertains will readily appreciate modifications and changes which may be made without departing from the spirit of the invention.

Therefore, I do not intend to be limited except by the scope of appended claims.

Having thus described the invention, what is claimed is:

1. A golf practising device which, when struck by a golf club, simulates the feel of hitting a conventional golf ball, said device comprising a base structure, a non-rotatable axle mounted in a fixed position on a horizontal axis to said base structure, An elongated mounting member pivotally rotatable at its centre point about said non-rotatable axle, a golf ball member mounted on each end of said mounting member, both said ball members and said mounting member being molded integral one with another of the same material, said ball members being substantially freely rotatable in a vertical plane while being retained in the immediate vicinity of said base structure, and said ball members counterweighting each other during rotation thereof, and reinforcing means mounted on said integral golf ball and mounting members, said reinforcing means extending substantially at right angles to said horizontal axis, said reinforcing means projecting outwardly from the faces of said mounting member, said reinforcing means comprising firstly a reinforcing member on each side face of said mounting member, each side face reinforcing member extending lengthwise from said golf ball members to the central portion of said mounting member, and secondly a reinforcing member on each of the front and rear faces of said mounting member, said front and rear face reinforcing members each extending lengthwise only part way between said golf ball members, said front face reinforcing member extending from one of said golf ball members and said rear face reinforcing member extending from the other of said golf ball members.

2. A device as claimed in claim 1, said device comprising adjustable means mounted on said base structure in order to alter the height of said golf ball member above said base structure.

3. A device as claimed in claim 1, said base structure having an upper surface which in use is flush with ground level, and said integral golf ball and mounting members being mounted to said base structure in such a way that said integral golf ball and mounting members are free to rotate substantially above and below ground level on being hit by a golf club.

4. A device as claimed in claim 1, said integral golf ball and mounting members being made from polyurethane.

* * * * *